US006522349B1

(12) United States Patent
Lee

(10) Patent No.: US 6,522,349 B1
(45) Date of Patent: Feb. 18, 2003

(54) SPACE SAVING INTEGRATED CARTRIDGE FOR A PRINTER

(75) Inventor: Yen-Chi Lee, Taipei (TW)

(73) Assignee: Hi-Touch Imaging Technologies Co., Ltd., Pan-Chiao ( * ) Notice: Subject to any disclaimer, the term of this patent is extended or adjusted under 35 U.S.C. 154(b) by 0 days.

(21) Appl. No.: 10/063,390

(22) Filed: Apr. 17, 2002

(51) Int. Cl.[7] ..... B41J 32/00; B41J 35/28; B41J 17/22; B41J 17/24

(52) U.S. Cl. ..... 347/214; 400/208.1

(58) Field of Search ..... 347/214; 400/207, 400/208, 208.1, 622, 624, 625

(56) References Cited

U.S. PATENT DOCUMENTS 5,216,441 A * 6/1993 Isobe ..... 400/208

FOREIGN PATENT DOCUMENTS

JP 4-101875 * 4/1992 ..... B41J/35/28

* cited by examiner

*Primary Examiner*—Huan Tran
(74) *Attorney, Agent, or Firm*—Winstonhsu

(57) ABSTRACT

A integrated cartridge of a printer has a paper cassette for holding paper, and a two-reel ribbon cassette for positioning a printer ribbon, connected by a pair of braces. The ribbon cassette is rotatable, with respect to the paper cassette, or collapsible to make the integrated cartridge more compact for storage.

8 Claims, 13 Drawing Sheets

SPACE SAVING INTEGRATED CARTRIDGE FOR A PRINTER

BACKGROUND OF INVENTION

1. Field of the Invention

The present invention relates to a printer cartridge, and more specifically, to an integrated cartridge having both a paper cassette and a ribbon cassette.

2. Description of the Prior Art

Integrated cartridges contain both printing material such as paper and imaging material such as ink film or ribbon. These cartridges are commonly used in printers that utilize a thermal print head. Integrated cartridges are time saving and convenient when compared with using two separate cartridges, as the user is only required to install and maintain one cartridge.

FIG. 1 shows a prior art integrated cartridge 20. The printing cartridge 20 comprises a paper cassette 21 for holding printing paper and an imaging material cassette 22 for imaging material. The imaging material is stored on rollers 23 and can be ink film, ink ribbon, or a similar roller based material. Disposed between the paper cassette 21 and the imaging material cassette 22 is a guide opening 24*a*, which has a paper inlet 24*b* at the upper end, and a paper outlet 24*c* at the lower end. Supporting the printing paper in the paper cassette 21 is a paper support plate 25*a* connected to and pivoting about a pin 25*b*. The pin 25*b* is attached at each end to the paper cassette 21.

Under normal installation, the printing cartridge 20 is disposed inside a printer 30, as shown in FIG. 2. The printer cartridge 20 is supported by support brackets 31, which are attached to the printer 30.

During operation of the printer 30 when a sheet of paper (represented by a dashed line in all figures) is to be supplied, a lever 32 is rotated upwards to raise and tilt the paper support plate 25*a*, which is caused to rotate about the pin 25*b*, as shown in FIG. 3. The top sheet of paper P is then brought into contact with a paper supplying belt 33. The paper supplying belt 33 feeds the sheet of paper, which is first diverted by a guiding plate 34, into the paper inlet 24*b* of the guide opening 24*a*. The sheet of paper is discharged out of the guide opening 24*a* through the paper outlet 24*c* and is taken up by a capstan roller 35 and a pinch roller 36. In this way, the sheet of paper is supplied to a platen roller 37 and a print head assembly 38.

After the sheet of paper has been supplied, printing to that sheet of paper may commence, as is illustrated in FIG. 4. The platen roller 37 rises to press the sheet of paper against the imaging material 1. The print head assembly 38 lowers to support the imaging material 1. Printing is carried out normally with the sheet of paper being taken up by a discharge belt 39, and the flow of the sheet of paper being the reverse of that during supplying. The sheet of paper is ejected out of the printer 30 by the discharge belt 39 when printing is complete.

The prior art integrated cartridge lacks a compact form for efficient storage.

SUMMARY OF INVENTION

It is therefore a primary objective of the claimed invention to provide an integrated cartridge, comprising both a paper cassette and a ribbon cassette, capable of being reduced in size for storage.

According to the claimed invention, an integrated cartridge for a printer includes a paper cassette for placing paper and a ribbon cassette for positioning a ribbon. The ribbon cassette has a first reel and a second reel, on which a ribbon is positioned. The integrated cartridge further includes a brace having a first end connected to the paper cassette and a second end connected to the first reel of the ribbon cassette. The second reel of the ribbon cassette is capable of moving relative to a position of the first reel so as to reduce a space occupied by the integrated cartridge.

It is an advantage that the claimed invention uses a movable second reel in the ribbon cassette resulting in reduced space occupied when stored.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
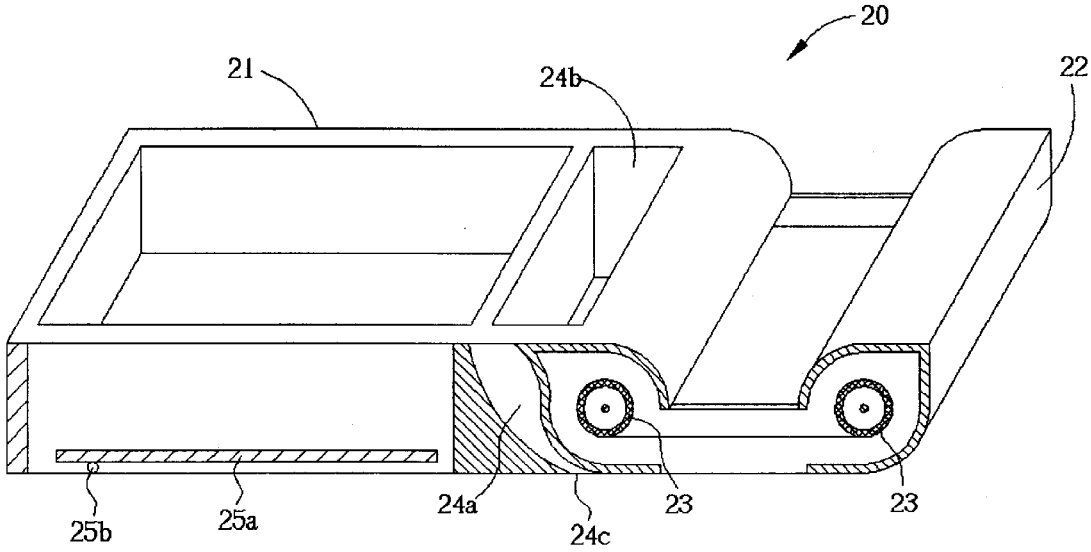
Fig. 1 Prior art
FIG. 1 is a perspective view of a prior art integrated cartridge.
Figure 2:
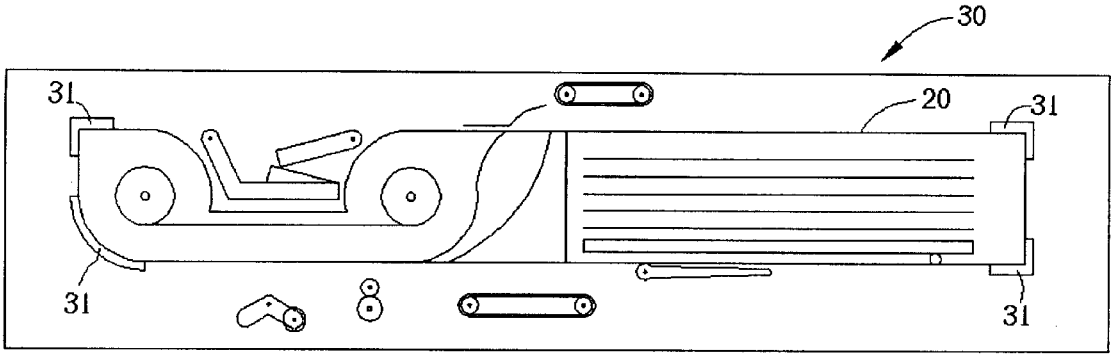
Fig. 2 Prior art
FIG. 2 is a cross-sectional view of the integrated cartridge shown in FIG. 1 installed into a printer.
Figure 3:
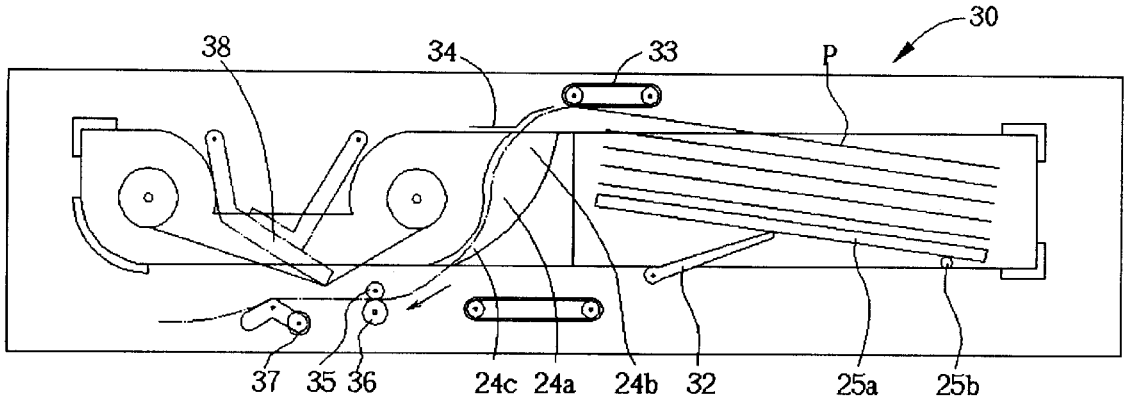
Fig. 3 Prior art
FIG. 3 and FIG. 4 are cross-sectional views of the operation of the installed integrated cartridge and printer shown in FIG. 2.
Figure 4:
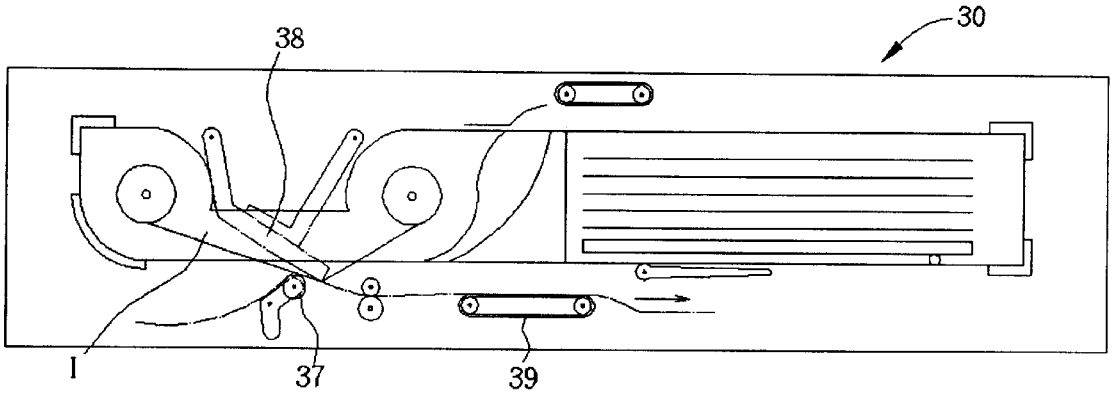
Fig. 4 Prior art
Figure 5:
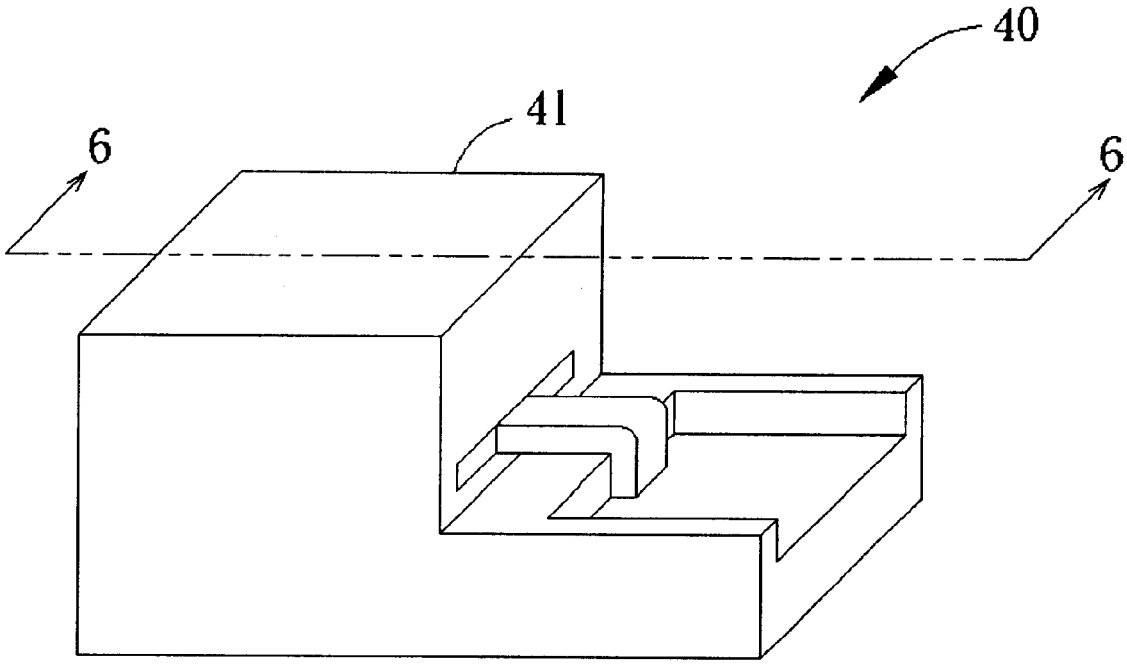
FIG. 5 is a perspective view of a printer according to the present invention.
Figure 6:
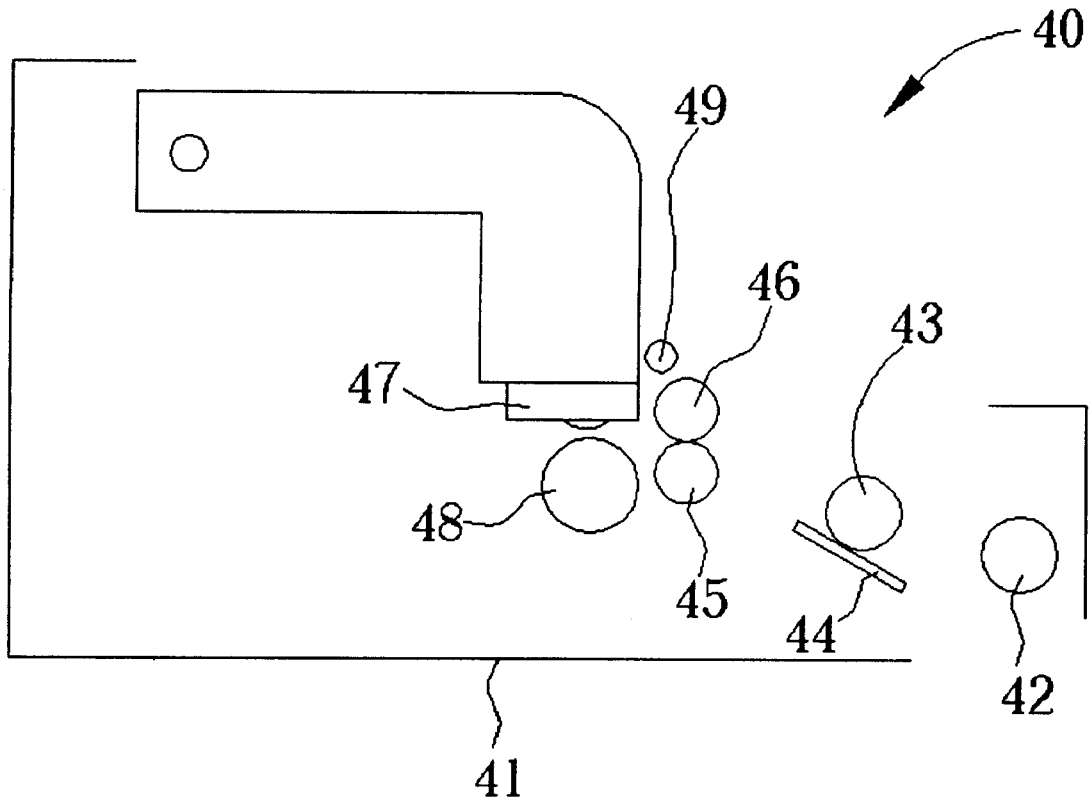
FIG. 6 is a cross-sectional view along line 6—6 of the printer shown in FIG. 5.

A printer 40 according to the present invention, as illustrated in FIG. 5, comprises a printer body 41. As shown in the cross-sectional view along line 6—6 of the printer 40 FIG. 6, the printer 40 includes a paper take-up roller 42, a paper separation roller 43, and a paper separation pad 44 all for feeding a sheet of paper to a capstan roller 45 and a pinch roller 46. Printing onto the sheet of paper is accomplished by use of a thermal print head 47, a platen roller 48, and a ribbon tension roller 49.

Figure 7:
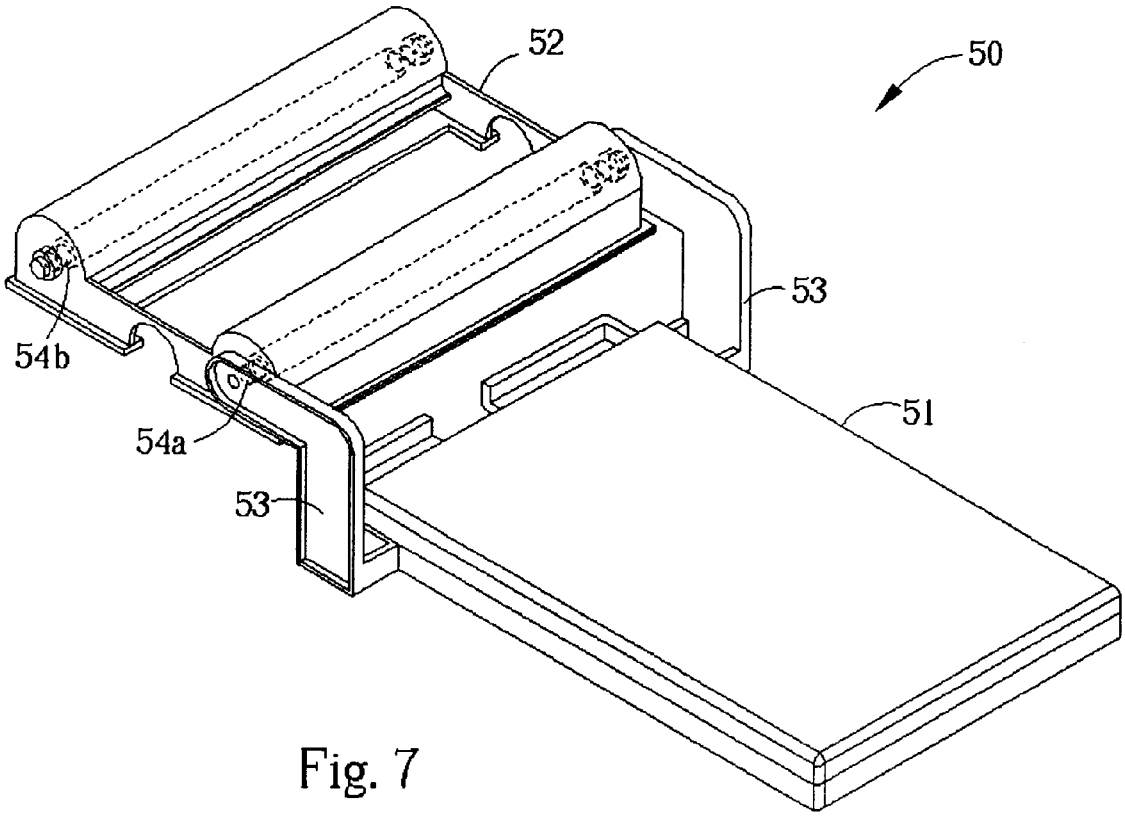
FIG. 7 is a perspective view of an integrated cartridge according to the present invention.

An integrated cartridge 50 according to the present invention, as shown in FIG. 7 in expanded form, includes a paper cassette 51 connected to a ribbon cassette 52 by a pair of braces 53. The paper cassette 51 holds a supply of paper and the ribbon cassette 52 contains an ink ribbon disposed on a first reel 54*a* and a second reel 54*b*.

The paper cassette 51 is attached to a first end of each brace 53 using a fixed connection. The ribbon cassette 52 is pivot connected to a second end of each brace 53 at the first reel 54*a* so that the ribbon cassette 52 can rotate 180° towards and over the paper cassette 51. The housing of the ribbon cassette 52 is constructed in such a way as to not interfere with the ribbon tension roller 49 and the pinch roller 46 of the printer 40.

Figure 8:
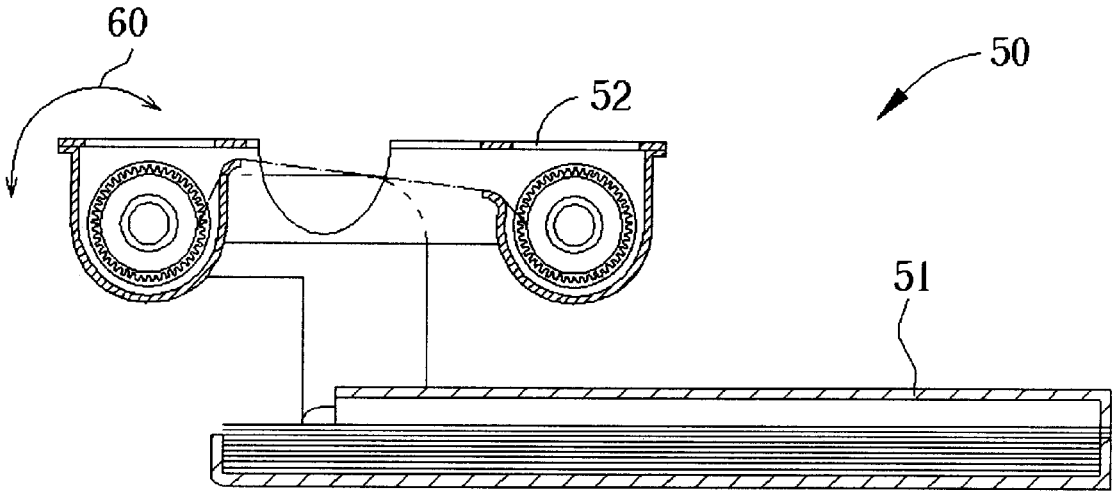
FIG. 8 is a cross-sectional view of the integrated cartridge shown in FIG. 7 in compact form.

Compact form of the integrated cartridge 50, when the ribbon cassette 52 is rotated towards the paper cassette 51, is illustrated in FIG. 8 with an arrow 60 indicating the rotation. The compact form is used for the purpose of storage. The integrated cartridge 50 can be installed into the printer 40 while in the compact form or alternately, while in the expanded form shown in FIG. 7.

Figure 9:
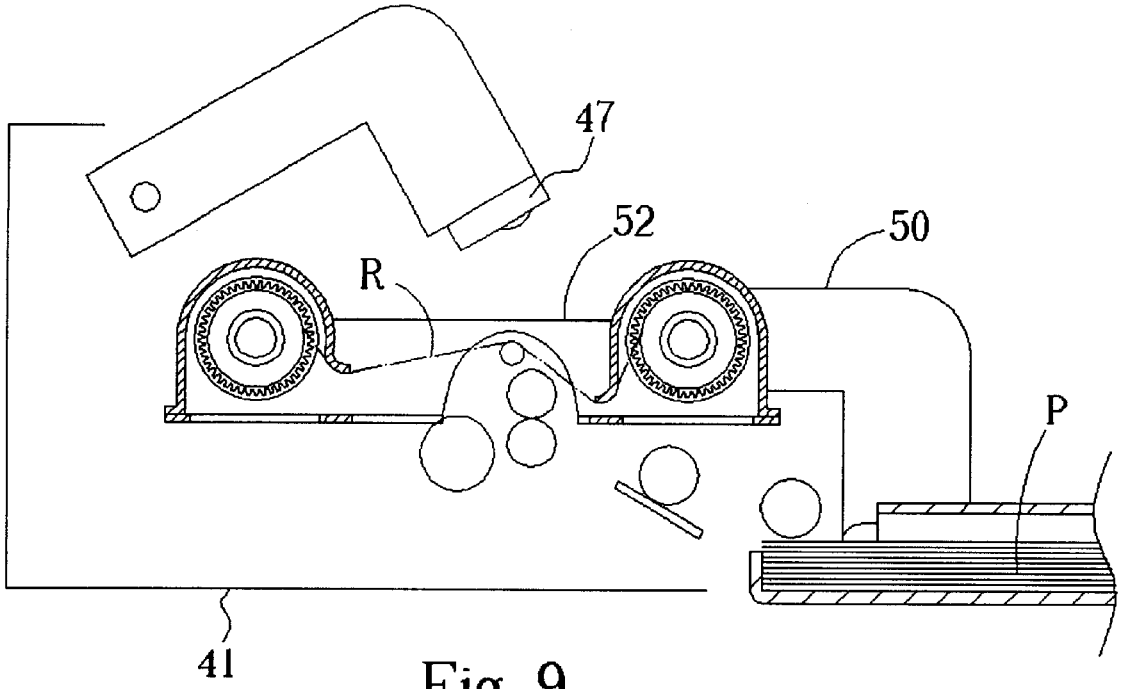
FIG. 9 is a cross-sectional view of the integrated cartridge shown in FIG. 7 in expanded form and installed into the printer shown in FIG. 6.
Figure 10:
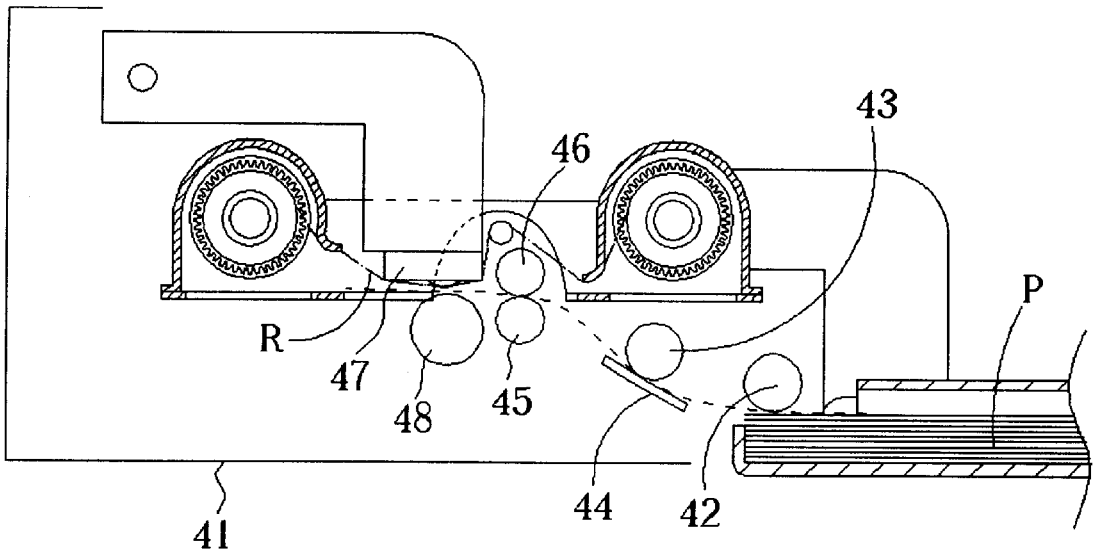
FIG. 10 is a cross-sectional view of the installed integrated cartridge shown in FIG. 9 during printing.

Please refer to FIG. 9 and FIG. 10, which detail the operation of the present invention integrated cartridge 50. First, the integrated cartridge 50 is installed onto the printer body 41 in the compact form. The thermal print head 47 is then lifted, as shown in FIG. 9, to allow the ribbon cassette 52 to be rotated into the printer body 41. Finally, the thermal print head 47 is lowered back into place and comes into contact with the ribbon R, as shown in FIG. 10. Printing is then carried out normally.

During the printing process, illustrated in FIG. 10, a sheet of paper (shown as a dashed line in FIG. 10) from the paper supply P is taken up by the paper take-up roller 42 and fed between the paper separation roller 43 and paper separation pad 44. The sheet of paper is then directed to the capstan roller 45 and the pinch roller 46, which drive the sheet of paper between the thermal print head 47 and platen roller 48. During printing, the platen roller 48 presses the sheet of paper firmly against the ribbon R, the ribbon R being supported by the thermal print head 47. The thermal print head 47 can then heat the ribbon R and print to the sheet of paper. When printing is complete, the capstan roller 45 and pinch roller 46 eject the sheet of paper from the printer body 41.

When the integrated cartridge 50 is to be removed from the printer body 41, the sequence performed is opposite that of installation. Specifically, the thermal print head 47 is lifted, the ribbon cassette 52 is rotated into the compact form, the integrated print cartridge 50 is detached from the printer body 41, and, finally, the thermal print head 47 is returned to its lower position. The integrated cartridge 50, now in the compact form, may be stored efficiently.

Figure 11:
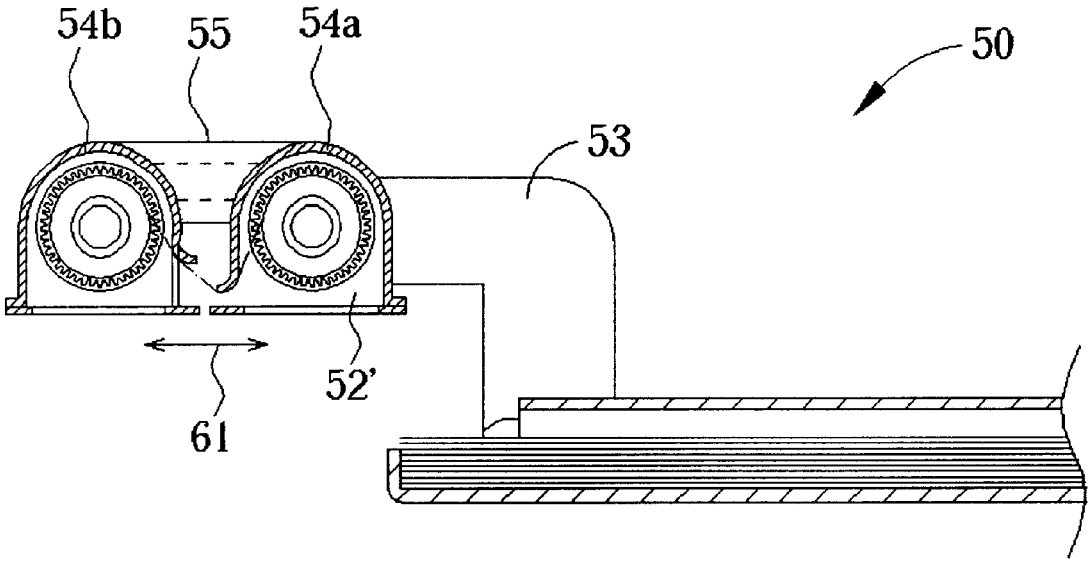
FIG. 11 is a cross-sectional view of an integrated cartridge shown in compact form according to a second embodiment of the present invention.

A second embodiment of the present invention includes a second reel 54*b* of a ribbon cassette 52" that can be moved in a transverse rather than rotational manner. This key difference between the second embodiment and the previously mentioned embodiment will now be detailed referencing FIG. 11, which shows a cross-sectional view of the integrated cartridge 50 in compact form. A first reel 54*a* of the ribbon cassette 52" is attached to the second end of each brace 53 using a fixed connection. The ribbon cassette 52" is extendable by means of a sliding mechanism 55, such that the second reel 54*b* can move in a transverse direction indicated by an arrow 61 in FIG. 11. The sliding mechanism 55 forms the sidewalls of the ribbon cassette 52" housing connecting the first reel 54*a* and the second reel 54*b*, and does not interfere with the ribbon tension roller 49, the pinch roller 46, or the thermal print head 47 of the printer 40.

Figure 12:
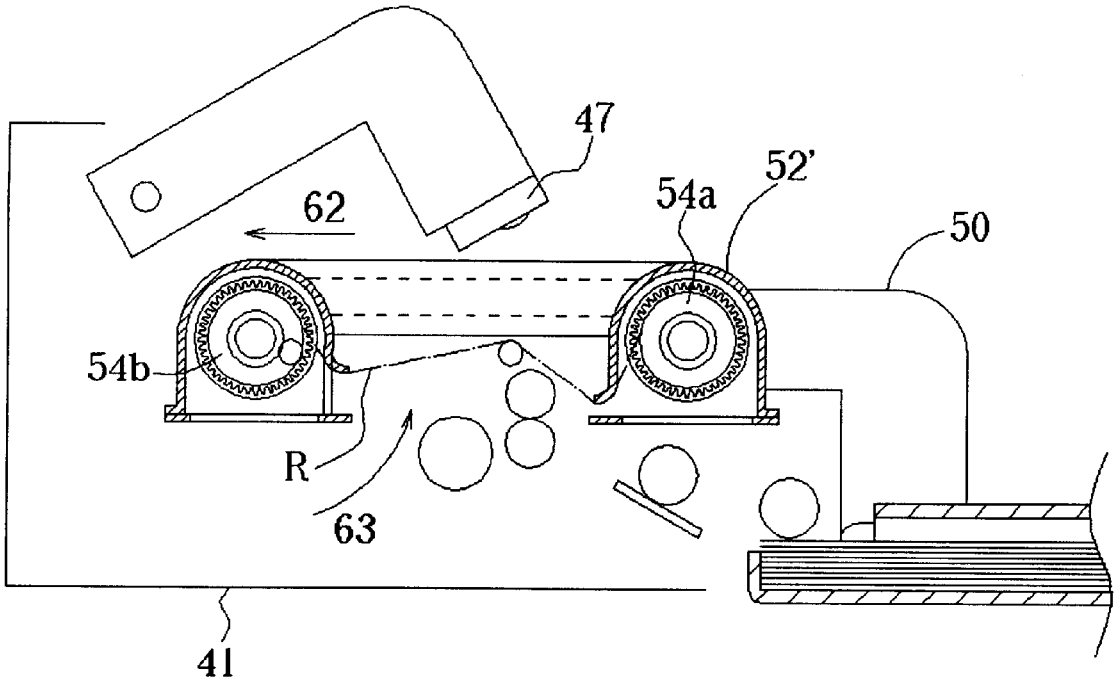
FIG. 12 is a cross-sectional view of the integrated cartridge shown in FIG. 11 in expanded form and installed into the printer shown in FIG. 6.
Figure 13:
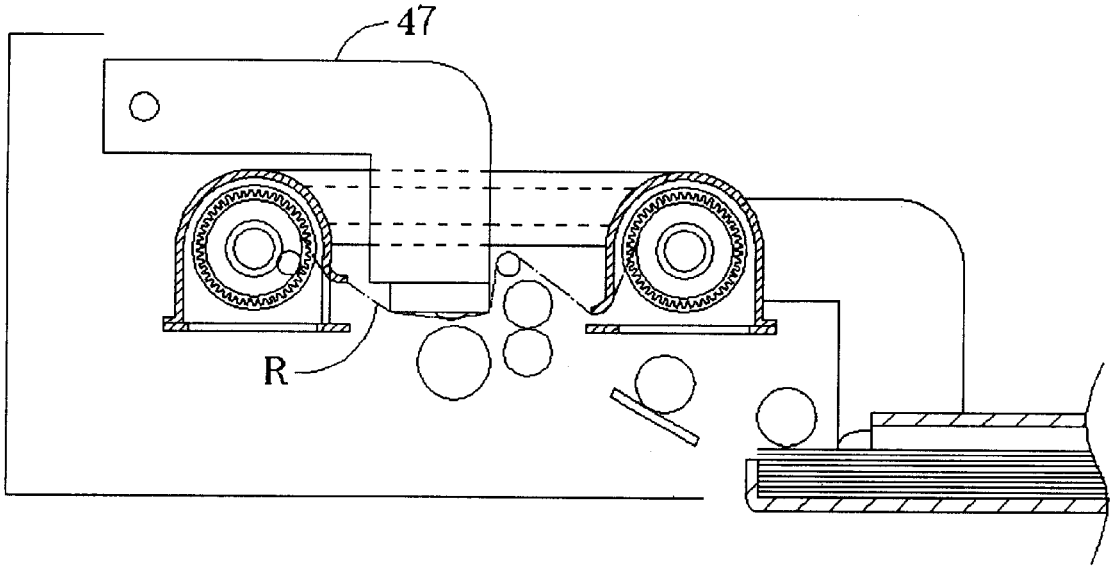
FIG. 13 is a cross-sectional view of the installed integrated cartridge shown in FIG. 12 during printing.

Please refer to FIG. 12 and FIG. 13, which detail the operation of the integrated cartridge 50 according to the second embodiment. First, the thermal print head 47 is lifted and the integrated cartridge 50 is installed onto the printer body 41 in the compact form. As shown in FIG. 12, the second reel 54*b* of the ribbon cassette 52" is slid, as indicated by a horizontal arrow 62, into the printer body 41. After the second reel 54*b* is slid into place, a chassis mechanism of the printer 40 raises the capstan roller 45, the pinch roller 46, the platen roller 48, and the ribbon tension roller 49 into place, as shown by an arrow 63 in FIG. 12. Finally, the thermal print head 47 is lowered back into place and comes into contact with the ribbon R, as shown in FIG. 13. Printing is then carried out in a manner identical to that described previously and illustrated in FIG. 10.

When the integrated cartridge 50 according to the second embodiment is to be removed from the printer 41, the sequence performed is opposite that of installation. First, the thermal print head 47 is lifted, and the chassis mechanism of the printer 40 lowers the capstan roller 45, the pinch roller 46, the platen roller 48, and the ribbon tension roller 49 to avoid interference as the second reel 54*b* of the ribbon cassette 52" is slid. The second reel 54*b* is then slid towards the first reel 54*a*, and then the integrated cartridge 50 is detached from the printer body 41. Finally, the thermal print head 47 is returned to its lower position. The integrated cartridge 50, now in the compact form, may be stored efficiently.

The present invention, in either embodiment, can be used with various kinds of paper and is independent of paper size, thickness, or texture. Similarly, the present invention can accommodate a wide variety of printing ribbons and is not limited by the ribbon described. Furthermore, the present invention is not limited by a specific style of printer provided the printer is reasonably similar to the one described.

In contrast to the prior art, the present invention uses a rotatable or collapsible ribbon cassette. The ribbon cassette thus allows the integrated cartridge to be reduced in size so that the integrated cartridge can be stored more efficiently than the prior art.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An integrated cartridge for a printer comprising:

a paper cassette for placing paper;

an imaging material cassette for positioning imaging material, the imaging material cassette having a first reel and a second reel; and at least a brace having a first end connected to the paper cassette and a second end connected to the first reel of the imaging material cassette;

wherein the second reel is capable of moving relative to a position of the first reel so as to reduce a space occupied by the integrated cartridge.

2. The integrated cartridge of claim 1 wherein the second reel is capable of rotating with respect to the first reel.

3. The integrated cartridge of claim 1 wherein the imaging material cassette is capable of being rotated to flip upside down.

4. The integrated cartridge of claim 1 wherein the second reel is capable of moving closer to or away from the first reel.

5. The integrated cartridge of claim 4 wherein after the integrated cartridge is installed inside the printer, the second reel will move away from the first reel.

6. The integrated cartridge of claim 1 wherein the printer comprises a thermal print head for heating the imaging material to print ink onto the paper.

7. The integrated cartridge of claim 6 further comprising a platen roller for pressing the paper against the thermal print head.

8. The integrated cartridge of claim 1 wherein the imaging material cassette is a ribbon cassette, and the imaging material is ribbon.

* * * * *